US010961100B2

(12) United States Patent
Lin et al.

(10) Patent No.: US 10,961,100 B2
(45) **Date of Patent: *Mar. 30, 2021**

(54) MAGNETIC SCREWDRIVER DEVICE

(71) Applicant: Industrial Technology Research Institute, Hsin-Chu (TW)

(72) Inventors: Chang-Min Lin, Taoyuan (TW); Wei-Chieh Chang, Tainan (TW); Hsuan-Yu Huang, Chiayi (TW)

(73) Assignee: INDUSTRIAL TECHNOLOGY RESEARCH INSTITUTE H, Hsin-Chu (TW)

( * ) Notice: Subject to any disclaimer, the term of this patent is extended or adjusted under 35 U.S.C. 154(b) by 190 days.

This patent is subject to a terminal disclaimer.

(21) Appl. No.: 16/367,913

(22) Filed: Mar. 28, 2019

(65) Prior Publication Data

US 2020/0071148 A1 Mar. 5, 2020

Related U.S. Application Data

(63) Continuation-in-part of application No. 16/118,607, filed on Aug. 31, 2018, now Pat. No. 10,780,439.

(30) Foreign Application Priority Data

Jan. 29, 2019 (TW) ..... 108103318

(51) Int. Cl.
*B67B 3/20* (2006.01)

(52) U.S. Cl.
CPC ..... *B67B 3/2086* (2013.01); *B67B 3/2053* (2013.01); *B67B 3/2066* (2013.01); *B67B 2201/065* (2013.01); *B67B 2201/10* (2013.01)

(58) Field of Classification Search
CPC ..... B25B 23/12; B25B 15/02; B67B 3/2066; B67B 3/2086; B67B 3/2053; B67B 2201/065; B67B 2201/10
See application file for complete search history.

(56) References Cited

U.S. PATENT DOCUMENTS 4,825,992 A 5/1989 Skrobisch
6,029,551 A * 2/2000 Wu ..... B25B 15/02 81/429

(Continued)

FOREIGN PATENT DOCUMENTS

CN 2717622 Y 8/2005
CN 201246422 Y 5/2009

(Continued)

OTHER PUBLICATIONS

Wendy Lorimer and Albert Hartman, "Magnetization Pattern for Increased Coupling in Magnetic Clutches", Sep. 1997, pp. 4239-4241vol. 33, No. 5, IEEE Transactions on Magnetics.

(Continued)

*Primary Examiner* — David B. Thomas
(74) *Attorney, Agent, or Firm* — WPAT PC

(57) ABSTRACT

A magnetic screwdriver device includes a pad without magnetism, a driving shaft, and a driven shaft. The two shafts, magnetically attracted to each other, are disposed on opposite sides of the pad. The driving shaft is used to transmit a torque to rotate the driven shaft. When the torque exceeds a predetermined value to overcome a friction force between the driven shaft and the pad, the driven shaft would be stopped.

18 Claims, 6 Drawing Sheets

(56) References Cited

U.S. PATENT DOCUMENTS

| | | | | |
|---|---|---|---|---|
| 7,181,892 | B1 | 2/2007 | Scott et al. | |
| 7,484,427 | B2 * | 2/2009 | Kolkind | B25B 23/103 73/761 |
| 7,788,997 | B2 * | 9/2010 | Kozak | B25B 15/02 81/451 |
| 8,474,225 | B2 | 7/2013 | Kramer et al. | |
| 8,562,909 | B2 | 10/2013 | Schacher | |
| 9,388,031 | B2 | 7/2016 | Schoenfelder | |
| 9,796,574 | B2 | 10/2017 | Frey et al. | |
| 10,780,439 | B2 * | 9/2020 | Lin | B67B 3/2066 |
| 2007/0261868 | A1 | 11/2007 | Gross | |
| 2008/0022808 | A1 | 1/2008 | Owen et al. | |
| 2008/0247914 | A1 | 10/2008 | Edens et al. | |
| 2009/0056285 | A1 | 3/2009 | Kramer et al. | |

FOREIGN PATENT DOCUMENTS

| | | | |
|---|---|---|---|
| CN | 201419373 | Y | 3/2010 |
| CN | 105171491 | A | 12/2015 |
| TW | 372907 | | 11/1999 |
| TW | I330575 | | 9/2010 |
| TW | M517668 | | 2/2016 |
| TW | 201631871 | | 9/2016 |

OTHER PUBLICATIONS

B. N. J. Persson, "Theory of rubber friction and contact mechanics", Aug. 22, 2001, pp. 3840-3861, vol. 115, No. 8, Journal of Chemical Physics.

Hyeon-Jae Shin et al., "Design and Analysis of Axial Permanent Magnet Couplings Based on 3D FEM", Jul. 2013, pp. 3985-3988, vol. 49, No. 7, IEEE Transactions on Magnetics.

A.V. Fedotov et al., "Analysis of the magnetized friction force", May 29-Jun. 2, 2006, pp. 210-214., Proceedings of HB2006, Tsukuba, Japan.

Gang-Hyeon Jang et al., "Torque characteristic analysis and measurement of axial flux-type noncontact permanent magnet device with Halbach array based on 3D analytical method", Feb. 3, 2017, American Institute of Physics.

Yushi Wang et al., "Exploiting the slip behavior of friction based clutches for safer adjustable torque limiters", Jul. 3-7, 2017, pp. 1346-1351, IEEE International Conference on Advanced Intelligent Mechatronics (AIM).

* cited by examiner

MAGNETIC SCREWDRIVER DEVICE

CROSS REFERENCE TO RELATED APPLICATION

This application is a Continuation-In-Part application of co-pending U.S. application Ser. No. 16/118,607, filed on Aug. 31, 2018, and claims the priority to Taiwan Patent Application No. 108103318 filed in the Taiwan Patent Office on Jan. 29, 2019, which is herein incorporated by reference in its entirety.

TECHNICAL FIELD

The disclosure relates in general to a magnetic screwdriver device, and more particularly to a device which is suitable for miniaturization and arraying, and which can treat capping or de-capping without overlocking.

BACKGROUND

It is known that, while in working, various types of magnetic screwdriver devices, including electric magnetic screwdrivers, are able to attach components such as caps/lids or screws. Because of complex structuring and large sizes of these screwdriver devices, they are not suitable for processing a large number of tiny caps or lids simultaneously.

For example, for multiple micro sample tubes arranged into an array format with small intervals to be simultaneously capped or de-capped (or locked or unlocked), it is obvious that, due to substantial occupations, the conventional screwdriver devices cannot be applied to work synchronously. In addition, since most of the conventional screwdriver devices are not furnished with torque-limiting mechanisms, thus, as a cap for an airtight structure is over tightened, an excessive torque applied for uncapping would be highly possible to damage the airtight structure, and might not be able to achieve successfully the uncapping. On the other hand, if the conventional screwdriver device is furnished with a torque-limiting mechanism, then the price for such a complicate-structured screwdriver driver would be inevitably higher. Also, replacing a driver head is not an easy task for the conventional screwdriver device with the torque-limiting mechanism.

Therefore, there is a need for a magnetic screwdriver device, that can be safe from overlocking, miniaturized, suitable for an array arrangement, and integrated into a screwdriver assembly for handling capping and/or uncapping upon multiple tiny sample tubes synchronously.

SUMMARY

The disclosure relates in general to a magnetic screwdriver device, and more particularly to a device which is suitable for miniaturization and arraying, and which can treat capping or de-capping without overlocking.

According to one embodiment of the disclosure, a magnetic screwdriver device includes a pad without magnetism, a driving shaft and a driven shaft. The driving shaft having magnetic attraction property is disposed on one side of the pad and in touch with the pad. The driven shaft having magnetic attraction property is disposed on the opposite side of the pad. Namely, the two shafts, magnetically attracted to each other, are disposed on two opposite sides of the pad. The driving shaft is used to transmit a torque to rotate the driven shaft. The driven shaft would be stopped when the torque exceeds a predetermined value.

The above and other aspects of the disclosure will become better understood with regard to the following detailed description of the preferred but non-limiting embodiment(s). The following description is made with reference to the accompanying drawings.

Figure 1:
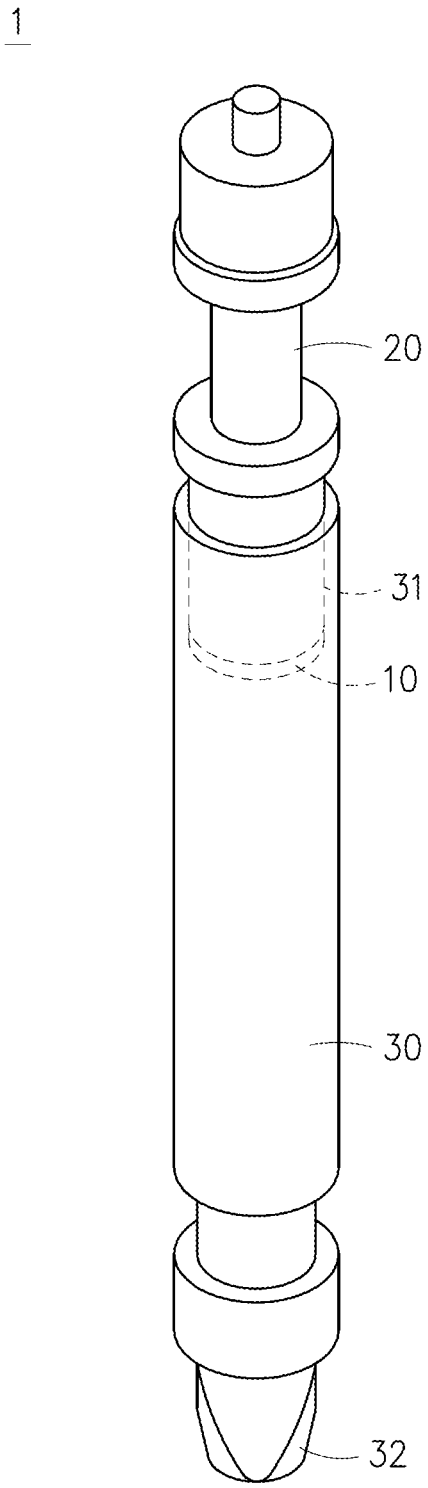
FIG. 1 is a schematic perspective view of a magnetic screwdriver device according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

A number of embodiments are disclosed below with accompanying drawings for elaborating the disclosure. However, the embodiments are for exemplary and explanatory descriptions only, not for limiting the scope of protection of the disclosure.

Figure 2:
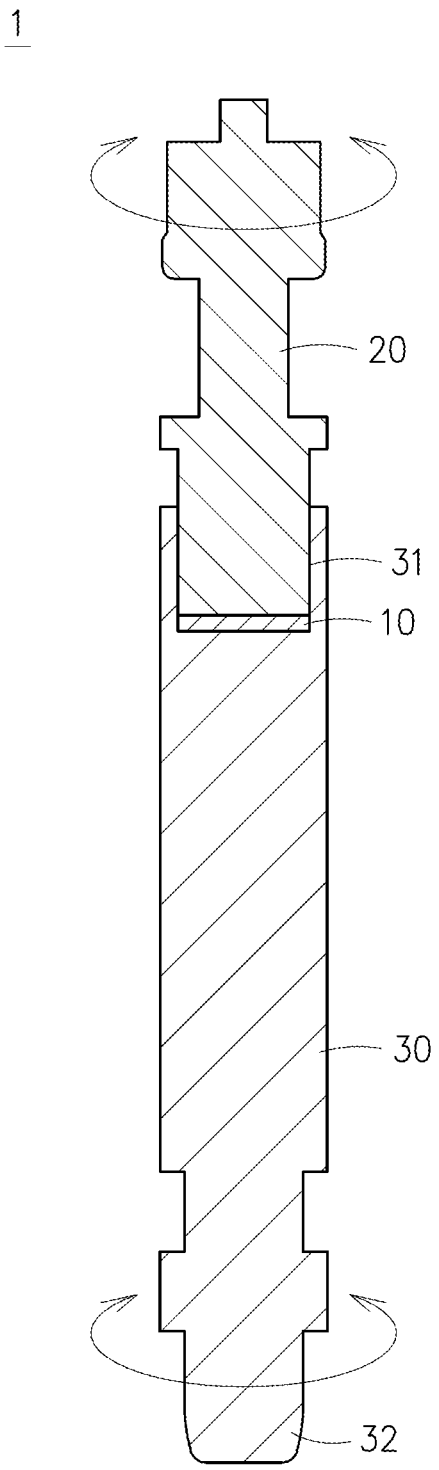
FIG. 2 is a schematic cross-sectional view of the magnetic screwdriver device of FIG. 1.

Refer to FIGS. 1 and 2, where a magnetic screwdriver device according to an embodiment of this disclosure is schematically shown in perspective and cross-sectional views, respectively. The magnetic screwdriver device 1 includes a pad 10, a driving shaft 20 and a driven shaft 30.

In an embodiment, the pad 10 without magnetism can be made of a metal, a plastic, a rubber, a ceramics or an organic compound such as Polydimethylsiloxane (PDMS).

The driving shaft 20 with a magnetic attraction property is disposed on one side (upper side in the figure) of the pad 10 and in touch with the pad 10. The driven shaft 30 is disposed on an opposite side (lower side in the figure) of the pad 10 away from the driving shaft 20 and also in touch with the pad 10.

As indicated in FIG. 2, an axial end (upper end in the figure) of the driven shaft 30 includes a first groove 31 for nesting the pad 10. A part of an axial end (lower end in the figure) of the driving shaft 20 extends downward into the first groove 31 and in touch with the pad 10. In the present embodiment, a bottom of the axial end (lower end in the figure) of the driving shaft 20 is positioned in touch with an surface of the pad 10, while a top of the axial end (upper end in the figure) of the driven shaft 30 is positioned in touch with a lower surface of the pad 10. In other words, the pad 10 is positioned in touch with of the inner surface of the first groove 31 of the driven shaft 30. The drive shaft 30 further connects a screwdriver 32 at an axial end (lower end in the figure) away from the pad 10. The screwdriver 32 is used to engage a lid of a workpiece prepared to be capped or de-capped.

At least one of the driving shaft 20 and the driven shaft 30 includes a magnet or a metal with a magnetic attraction property, such that the two shafts 20, 30 can be magnetically attracted to each other. In an embodiment, the driving shaft 20 includes a metal with magnetism, and the driven shaft 30 includes a magnet. In another embodiment, the driving shaft 20 includes a magnet, and the driven shaft 30 includes a metal with magnetism. In a further embodiment, both of the driving shaft 20 and the driven shaft 30 include magnets.

The two shafts 20 and 30, magnetically attracted to each other, are disposed on opposite sides of the pad 10. The driving shaft 20, actuated to rotate, is used to transmit a torque to rotate the driven shaft 30 synchronously. For both of the two shafts 20 and 30 are in touch with the pad 10, the torque would be generated, based on a friction force between the driving shaft 20 and the pad 10 and another friction force between the driven shaft 30 and the pad 10. When the torque exceeds a predetermined value to overcome the friction force between the driven shaft 30 and the pad 10, rotations of the driven shaft 30 would be stopped.

Different magnitudes of the torque can be generated by matching the pad 10, the driving shaft 20, and the driven shaft 30 with different combinations of materials and sizes. In one embodiment, the pad 10 is a circular plate made of Polydimethylsiloxane (PDMS) and having a 6 mm diameter and a 1 mm thickness, and materials to form the two shafts 20 and 30 include an alloy steel and a Neodymium iron boron magnet. Thus, the corresponding magnetic attraction force would be 7.63 Newton and the resulted torque would be within 0.2~0.3 kgf-cm.

Figure 3:
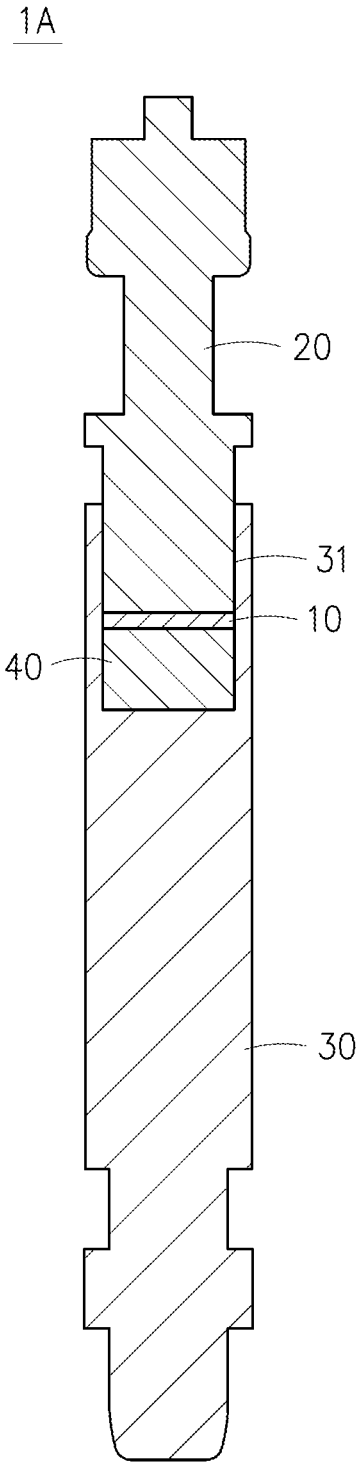
FIG. 3 to FIG. 7 are schematic cross-sectional views of the magnetic screwdriver device according to different embodiments of the disclosure.

FIG. 3 is a schematic cross-sectional view of another embodiment of the magnetic screwdriver device 1A according to this disclosure. A magnet 40 is attaching to the pad 10 at the side close to the driven shaft 30. The two shafts 20 and 30 can be made of metals with the magnetic attraction properties. In another exemplary example, the magnet 40 is bound to the driven shaft 30 without the magnetic attraction property, such that the two shafts 20 and 30 can be still magnetically attracted to each other.

Figure 4:
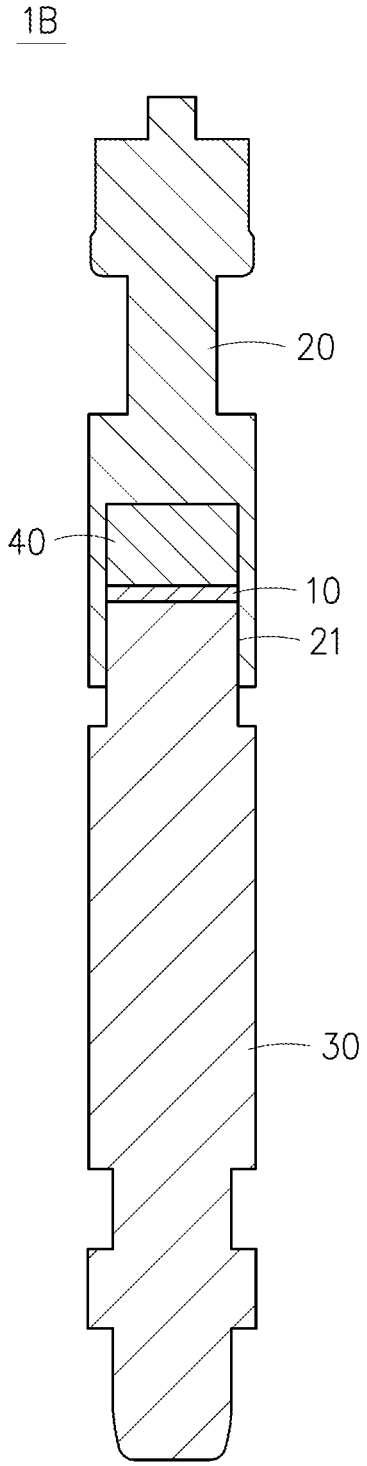

FIG. 4 is a schematic cross-sectional view of a further embodiment of the magnetic screwdriver device 1B according to this disclosure. A magnet 40 is attached to the pad 10 at the side close to the driving shaft 20, and the lower axial end of the driving shaft 20 includes a second groove 21 for nesting the pad 10. A part of the upper axial end of the driven shaft 30 extends into the second groove 21 and in touch with the pad 10. Materials for the two shafts 20 and 30 can be metals with the magnetic attraction properties. In another exemplary example, the magnet 40 is bound to the driving shaft 20 without the magnetic attraction property, such that the two shafts 20 and 30 can be still magnetically attracted to each other.

Figure 5:
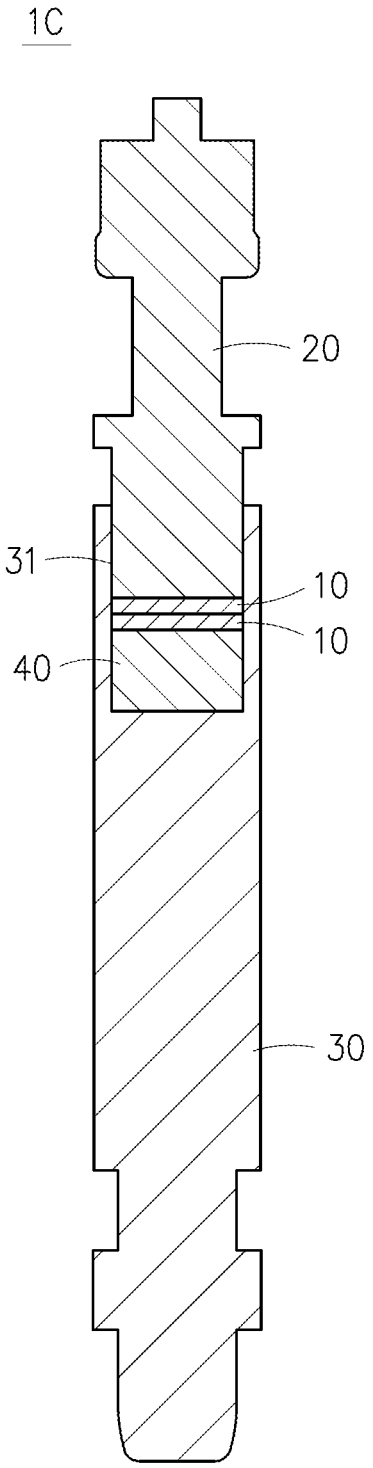

FIG. 5 is a schematic cross-sectional view of a further embodiment of FIG. 3. The difference between FIG. 5 and FIG. 3 is that, in this embodiment, two pads 10 are displaced together in an overlapping form. Through frictions between the two pads 10, the aforesaid resulted torque can be adjusted. In this embodiment, the individual outer surfaces of these two pads 10 (that is, the two surfaces away from contact surfaces between these two pads 10) contact the driving shaft 20 and the magnet 40, respectively. In one exemplary example, the contact surfaces of the two pads 10 include specific surface structures such as trench structures (jagged surfaces for example) or rough surface structures (nodal surfaces, sanded surfaces, or the like micro surface structures for example) for adjusting the torque transmitted to rotate the driven shaft 30. Further, in another exemplary example, more than two pads 10 piled together can be included.

In addition, the embodiments of FIG. 2 and FIG. 4 can apply the design shown in FIG. 5 to include more than two pads 10. In the case that the embodiment of FIG. 2 has at least two pads 10 laminated together, these pads 10 would be sandwiched between the driving shaft 20 and the driven shaft 30. On the other hand, in the case that the embodiment of FIG. 4 has at least two pads 10 laminated together, these pads 10 would be sandwiched between the magnet 40 and the driven shaft 30.

Figure 6:
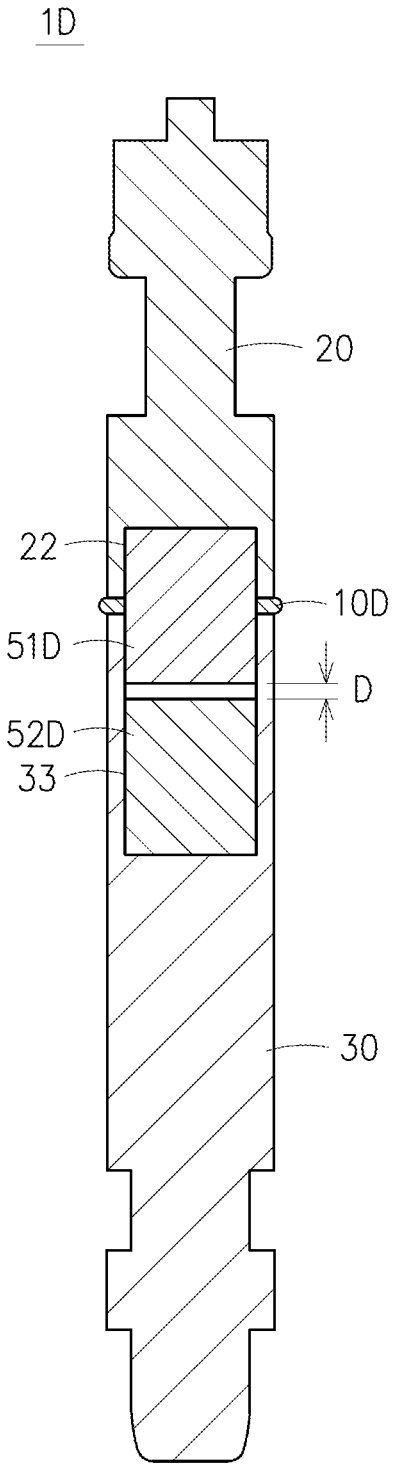

FIG. 6 is a schematic cross-sectional view of further one more embodiment of the magnetic screwdriver device 1D according to this disclosure. An axial end (lower end in the figure) of the driving shaft 20 includes a third groove 22, and an axial end (upper end in the figure) of the driven shaft 30 facing the third groove 22 includes a fourth groove 33. In this embodiment, the pad 10D is an annular element positioned between the two shafts 20 and 30. A first magnetic attraction element 51D is disposed in the third groove 22, with a portion of the first magnetic attraction element 51D extending into the fourth groove 33. Furthermore, a second magnetic attraction element 52D is disposed in the fourth groove 33. A predetermined gap D is furnished between the first magnetic attraction element 51D and the second magnetic attraction element 52D.

In the embodiment of FIG. 6, the lower axial end of the driving shaft 20 and the upper axial end of the driven shaft 30 are in touch with opposite sides of the pad 10D, respectively, and the first magnetic attraction element 51D contacts an inner wall of the pad 10D. In one exemplary example, the driving shaft 20 and the first magnetic attraction element 51D are integrated as a unique piece, and the driven shaft 30 and the second magnetic attraction element 52D are also integrated as a unique piece. In another exemplary example, the first magnetic attraction element 51D is bound (by adhering for example) to the driving shaft 20 without the magnetic attraction property, and the second magnetic attraction element 52D is bound to the driven shaft 30 without the magnetic attraction property. Thereupon, more magnetic attraction can be provide between the driving shaft 20 and the driven shaft 30.

In a further embodiment not shown here, the magnetic screwdriver device 1D shown in FIG. 6 can be furnished with more than two pads 10D laminated together. In such an embodiment, these pads 10D as a combination would be sandwiched between the driving shaft 20 and the driven shaft 30, and inner walls of the pads 10D would contact the first magnetic attraction element 51D.

Figure 7:
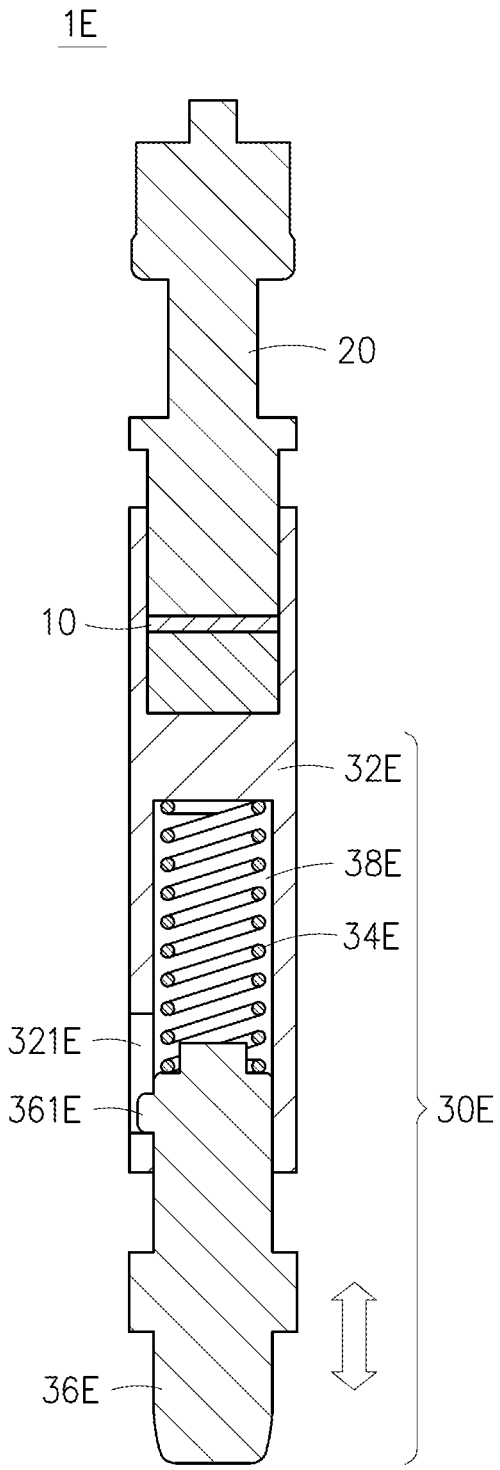

Referring to FIG. 7, an embodiment derived from the foregoing embodiments of FIGS. 2, 3, 4, 5 and 6 is shown. In this embodiment, the upper axial end of the driven shaft 30E is furnished with a first groove 31, and the pad 10 is set inside the first groove 31. A lower portion of the driving shaft 20 is extended into the first groove 31 so as to contact the pad 10. A magnet 40 connecting the driven shaft 30E inside the first groove 31 is disposed under and in contact with the pad 10. As shown, the driven shaft 30E includes an axle body 32E, a buffer element 34E and a screwdriver 36E. The magnet 40, the pad 10 and the driving shaft 20 are disposed to one upper axial end of the axle body 32E, and a lower axial end of the axle body 32E includes a third groove 38E. The buffer element 34E is disposed in the fifth groove 38E. The screwdriver 36E includes an upper axial end extending into the fifth groove 38E and in touch with the buffer element 34E. In this embodiment, the buffer element 34E includes a spring. Furthermore, the axle body 32E includes a slot 321E connected spatially with the fifth groove 38E, and a longitudinal direction of the slot 321E is parallel to an extending axis of the axle body 32E. The upper axial end of the screwdriver 36E extending into the fifth groove 38E is furnished with a flange part 361E to be embedded in the slot 321E. Upon such an arrangement, while the screwdriver 36E engaged with the lid of the workpiece to be capped or de-capped is pushed into the fifth groove 38E, the flange part 361E can slide along the slot 321E, and a cushioning force resulted from the buffer element 34E would prevent the screwdriver 36E from possible impact damage.

In the embodiment of FIG. 7, a further embodiment can be provided by including more than two pads 10. These pads 10, laminated together, are sandwiched between the driving shaft 20 and the magnet 40.

Figure 8:
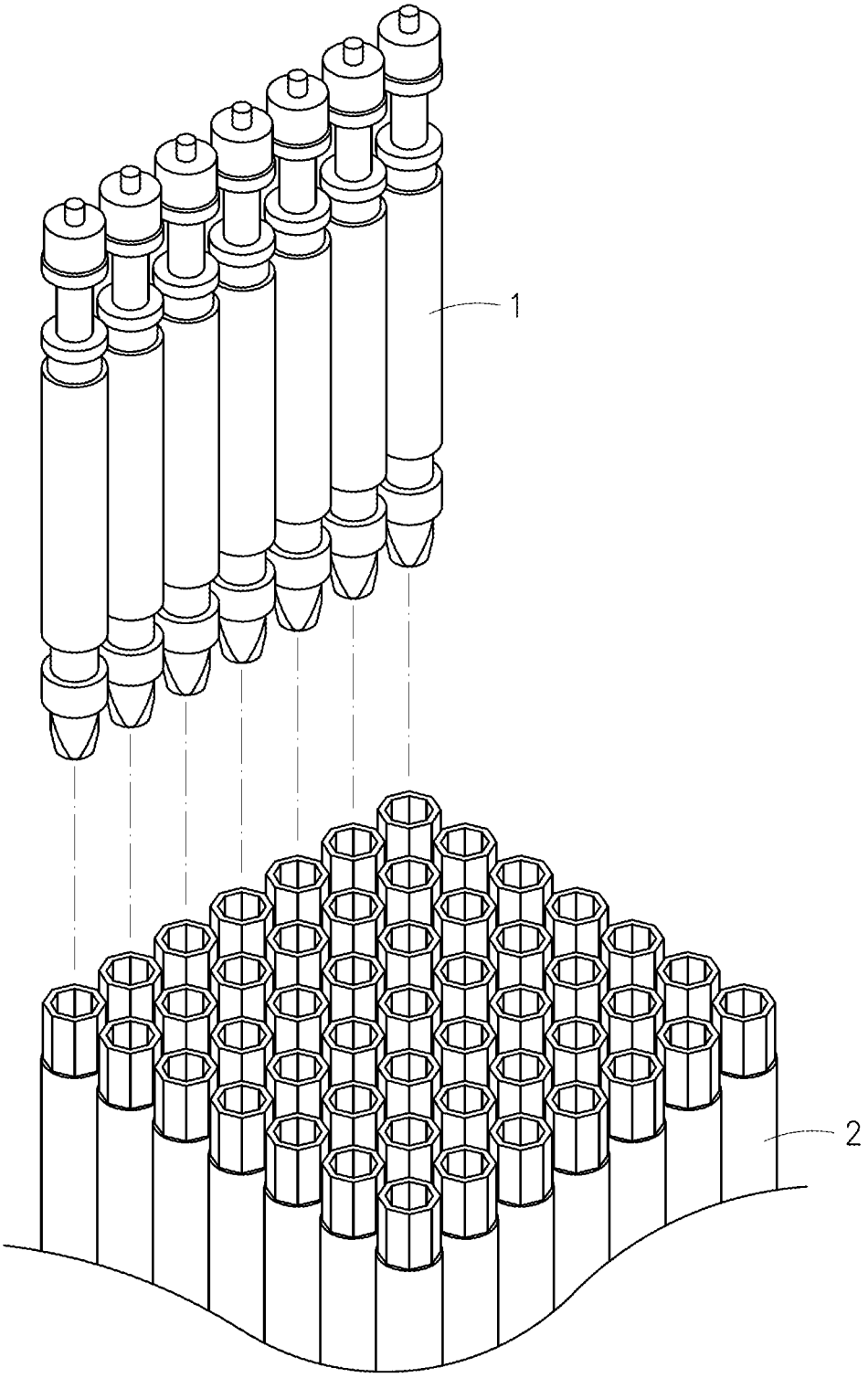
FIG. 8 shows schematically the capping/de-capping process applied to arrayed workpieces by using the magnetic screwdriver devices of FIG. 1.

The magnetic screwdriver device 1 in accordance with the present disclosure is suitable for a mass capping or de-capping process, such as removing/closing closures or lids from multiple sample tubes or reagent containers by a rotational movement. The friction force resulted from the rotation between the driving shaft and the driven shaft can prevent from overlocking. FIG. 8 is a schematic perspective view showing the capping/de-capping process applied to array sample tubes by using the magnetic screwdriver devices 1. In the present embodiment, a plurality of the magnetic screwdriver devices 1 is arranged into a matrix form matching vertical and horizontal intervals of the array sample tubes. Likewise, the plurality of the magnetic screwdriver devices 1 can be arranged into at least one row. Therefore, the capping/de-capping process applied to array sample tubes simultaneously can be performed.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A magnetic screwdriver device, comprising:

a pad without magnetism;

a driving shaft with a magnetic attraction property, disposed on one side of the pad and in touch with the pad; and a driven shaft, disposed on an opposite side of the pad respective to the driving shaft and in touch with the pad;

wherein the driving shaft and the driven shaft are magnetically attracted to each other;

wherein, when a torque transmitted from the driving shaft to rotate the driven shaft exceeds a predetermined value, the driven shaft is stopped.

2. The magnetic screwdriver device of claim 1, wherein at least one of the driving shaft and the driven shaft includes a magnet or a metal with the magnetic attraction property, such that the driving shaft and the driven shaft are magnetically attracted to each other.

3. The magnetic screwdriver device of claim 1, wherein the pad is made of one of a metal, a plastic, a rubber, a ceramics and an organic compound.

4. The magnetic screwdriver device of claim 3, wherein the pad is made of a Polydimethylsiloxane.

5. The magnetic screwdriver device of claim 1, wherein an axial end of the driven shaft includes a first groove for nesting the pad, and a portion of an end of the driving shaft extends into the first groove and in touch with the pad.

6. The magnetic screwdriver device of claim 5, wherein an axial end of the driving shaft includes a second groove for nesting the pad, and a portion of an end of the driven shaft extends into the second groove and in touch with the pad.

7. The magnetic screwdriver device of claim 6, wherein a magnet is attached to the pad at the side close to the driving shaft.

8. The magnetic screwdriver device of claim 7, wherein the driving shaft and the driven shaft are magnetically attracted to each other.

9. The magnetic screwdriver device of claim 7, wherein the magnet is bound to the driving shaft without the magnetic attraction property.

10. The magnetic screwdriver device of claim 6, wherein:

an axial end of the driving shaft includes a third groove;

an axial end adjacent to the third groove of the driven shaft includes a fourth groove;

the pad includes an annular element positioned between the driving shaft and the driven shaft;

a first magnetic attraction element disposed in the third groove has a portion of an axial end thereof to extend into the fourth groove;

a second magnetic attraction element is disposed in the fourth groove; and a predetermined gap is arranged between the first magnetic attraction element and second magnetic attraction element.

11. The magnetic screwdriver device of claim 10, wherein the driving shaft and the driven shaft are magnetically attracted to each other, and the driving shaft and the first magnetic attraction element are integrated as a unique piece, and the driven shaft and the second magnetic attraction element are also integrated as a unique piece.

12. The magnetic screwdriver device of claim 10, wherein the first magnetic attraction element is bound to the driving shaft without the magnetic attraction property, and the second magnetic attraction element is bound to the driven shaft without the magnetic attraction property.

13. The magnetic screwdriver device of claim 10, wherein the driven shaft includes:

an axle body, including one axial end displacing the pad and the driving shaft, and another axial end including a fifth groove;

a buffer element, disposed in the fifth groove; and a screwdriver, including an axial end extending into the fifth groove and in touch with the buffer element.

14. The magnetic screwdriver device of claim 13, wherein the buffer element includes a spring.

15. The magnetic screwdriver device of claim 13, wherein the axle body includes a slot connected spatially with the fifth groove, a longitudinal direction of the slot is parallel to an axis of the axle body, and the axial end of the screwdriver extending into the fifth groove includes a flange part embedded in the slot.

16. The magnetic screwdriver device of claim 1, wherein a magnet is attached to the pad at the side close to the driven shaft.

17. The magnetic screwdriver device of claim 16, wherein the driving shaft and the driven shaft are magnetically attracted to each other.

18. The magnetic screwdriver device of claim 16, wherein the magnet is bound to the driven shaft without the magnetic attraction property.

* * * * *